US007097060B2

(12) United States Patent
Penny et al.

(10) Patent No.: US 7,097,060 B2
(45) Date of Patent: Aug. 29, 2006

(54) CONTAINER WITH NON-EVERTING HANDGRIP

(75) Inventors: Michael E. Penny, Saline, MI (US); John A. Nievierowski, Ann Arbor, MI (US); Jonathan P. Jarman, Ypsilanti, MI (US)

(73) Assignee: Amcor Limited, Abbotsford (AU)

( * ) Notice: Subject to any disclaimer, the term of this patent is extended or adjusted under 35 U.S.C. 154(b) by 221 days.

(21) Appl. No.: 10/730,842

(22) Filed: Dec. 5, 2003

(65) Prior Publication Data

US 2005/0121409 A1 Jun. 9, 2005

(51) Int. Cl.
*B65D 23/10* (2006.01)
*B65D 1/02* (2006.01)

(52) U.S. Cl. ..... 215/384; 215/398; 220/771

(58) Field of Classification Search ..... 215/383, 215/384, 398; 220/675, 771
See application file for complete search history.

(56) References Cited

U.S. PATENT DOCUMENTS 3,232,495 A * 2/1966 Schueider ..... 222/209
D279,167 S * 6/1985 Haney et al. ..... D9/540
4,804,097 A 2/1989 Alberghini et al.
4,813,556 A * 3/1989 Lawrence ..... 215/11.3
4,890,752 A 1/1990 Ota et al.
4,993,565 A * 2/1991 Ota et al. ..... 215/384
5,226,550 A 7/1993 Mikolaitis et al.
5,472,105 A * 12/1995 Krishnakumar et al. .... 215/384
5,579,937 A * 12/1996 Valyi ..... 215/384
5,598,941 A 2/1997 Semersky et al.
6,223,920 B1 5/2001 Lane et al.
2003/0075521 A1* 4/2003 Miura ..... 215/384

* cited by examiner

*Primary Examiner*—Sue A. Weaver
(74) *Attorney, Agent, or Firm*—Emch, Schaffer, Schaub & Porcello Co., L.P.A.

(57) ABSTRACT

Blow-molded containers such as the 1.75-liter size for liquor beverages have an everting grip problem. Using inwardly facing grip geometry, consisting of two convex surfaces that come together at an inward ridge, eliminates the problem. The combination of the two convex surface sidewalls further eliminates the need for lateral reinforcing ribs in both cold-fill and hot-fill containers. The curved sidewalls come together at an edge offset the central axis of the container.

18 Claims, 6 Drawing Sheets

CONTAINER WITH NON-EVERTING HANDGRIP

TECHNICAL FIELD

The present invention relates to a plastic container that resists deformation. More specifically, this invention relates to plastic bottles having handgrip indentations that do not evert. The handgrips of this invention take advantage of structural rigidity geometry to eliminate the need for unsightly lateral reinforcing ribs.

BACKGROUND OF THE INVENTION

Thin-walled thermoplastic polymeric containers have been adapted for use to contain a wide range of products manufactured by cold fill and hot fill methods. The advantageous features of thin walled polymeric containers are well known including low cost container manufacturing and presentation of product in aesthetically pleasing lightweight shapes. New designs of these containers locate handgrips into the surface of the container. The handgrips generally comprise opposed indentations in the sidewall of the container. These indentations provide an accommodating fit for the thumb and fingers. While the indentations enhance the handling characteristics of the bottle relative to pouring liquid product from the bottle, the handgrip indentations have presented some problems.

The handgrips can evert quite easily due to hydraulic shock or thermal shock. This problem is particularly common in the 1.75-liter container commonly used in the liquor industry. The hydraulic shock created by dropping a full container less than two feet, a common practice when packing the full containers into a carton for transport, can cause conventional handgrip indentations to evert.

Containers for hot-fill applications have encountered problems with handgrips everting from thermal shock and expansion during the hot-fill process. The everted handgrip indentations take a set in the outwardly projecting position to such a point that the handgrips of the container will not revert to the initially designed, inwardly projecting configuration, upon cooling.

Known prior art handgrips commonly have walls with converging straight sides. The convergence angles of the prior art joined walls are all generally very obtuse and shallow. These containers are unsatisfactory in that such shallow and flat handgrips commonly evert. To solve this problem the prior art offers a solution of reinforcing the handgrip by providing at least one laterally oriented grip rib. Users, however, often recognize such prior art ribs as aesthetically unpleasing and as sacrificing grip feel. See, for example, U.S. Pat. Nos. 4,804,097, 4,890,752, 5,226,550, and 6,223,920.

U.S. Pat. No. 5,598,941 teaches a different solution, for the prevention of everting handgrips, than the previously cited art. The '941 patent discloses a hot-fill container having inwardly inset and opposed flex panels. Each of the flex panels includes a grip structure defined by a pair of flat inwardly directed wall sections conjoined to form a trapezoidal grip panel. Three sides of the conjoined wall sections define an inwardly directed rib. During the fill of the hot product, the flex-panels tend to absorb the thermal expansion and the three-sided inwardly directed rib serves to strength the grip panel to prevent it from everting. The combination of flex panels and rib facilitates the structural integrity of the bottle. However, such a bottle is complicated to manufacture and quality control issues arise concerning the geometry of the flex panels, grip panel, and three-sided rib. Flowing material through the blow molding process is difficult when using such complicated geometry. Further, the use of flex panels is aesthetically undesirable.

Therefore, it is an object of this invention to simplify yet strengthen the handgrip structure of a thermoplastic polymeric container to prevent everting of the handgrip due to hydraulic or thermal shock.

SUMMARY OF THE INVENTION

To remedy the everting grip problem, the inventors developed a grip that takes advantage of structural rigidity geometry. The grip includes first and second walls defining a grip recess. The walls converge along an axial line to form an inward edge at the depth of the recess. Preferably, the walls converge at a point slightly offset from below the cross-sectional centerline of the container. (See FIGS. 3, 4, and 5.) The first and second walls each have respective contour radii. The contours may have the same radii, but are preferably of different radii.

The invention lies in the convex design of the walls defining the grip (as one views these walls from the outside). An axially oriented and inwardly directed rib is preferably located at the axially oriented conjoined edge of the convex walls. The angular relationship of the first and second walls with convex contours that establishes the inward directed rib or ridge allows the handgrip to better absorb forces created by thermal or hydraulic shock, thus dissipating the impact of the forces.

The axially oriented inwardly directed rib improves upon the prior art structures, especially that shown in the '941 patent in two distinct and very important ways. The ridge is axially oriented, not three sided, and formed in a location offset from the centerline of the container. These two structural features facilitate the manufacture of the container by providing a less complex geometry and assisting even material flow during the blow molding process by preventing material hang up on a ridge in the mold. Thus, this invention significantly lessens undesirable quality control issues.

Fundamentally, the invention is a blow-molded container having a central axis and made of a polymer. The container has a body having a sidewall, adjoined on opposite ends by a shoulder and a bottom. Adjacent to the shoulder is a neck and adjacent to the neck is a finish providing an opening to the container. The sidewall has a pair of inwardly facing grip recesses spaced about its periphery. Each of the grip recesses has a top wall and a bottom wall, and extending between the top and bottom wall is a first sidewall and a second sidewall. The first and second sidewalls converge to form an inward ridge. In addition, the first and second sidewalls each have a surface with a generally convex appearance with a cross-sectional curvature. The curvature of the second sidewall is different from the curvature of the first sidewall.

The uniqueness of the opposing concave radii grip of our invention comes from its ability to address grip eversion and improve tactile feel without sacrificing appearance. The everting grip problem is eliminated by using geometry that consists of two side walls having a radii wherein the side walls come together at an offset, inwardly oriented ridge. The combination of the axial edge and concave sidewalls eliminates the need for additional complex and unnecessary grip structure in both cold fill and hot-fill containers.

DETAILED DESCRIPTION OF THE INVENTION

Figure 1:
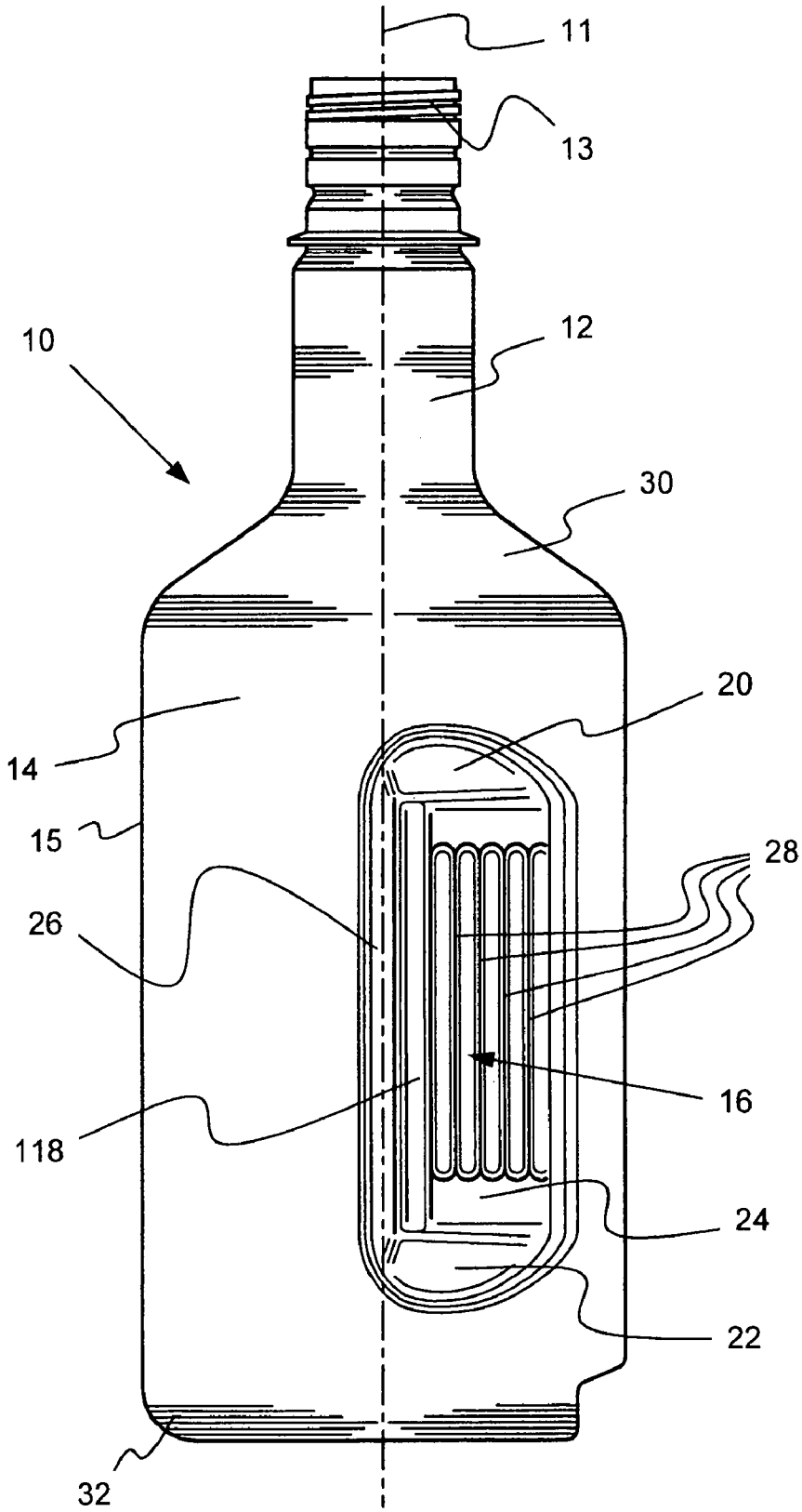
FIG. 1 is a side elevational view of a blow-molded plastic container according to the present invention.
Figure 2:
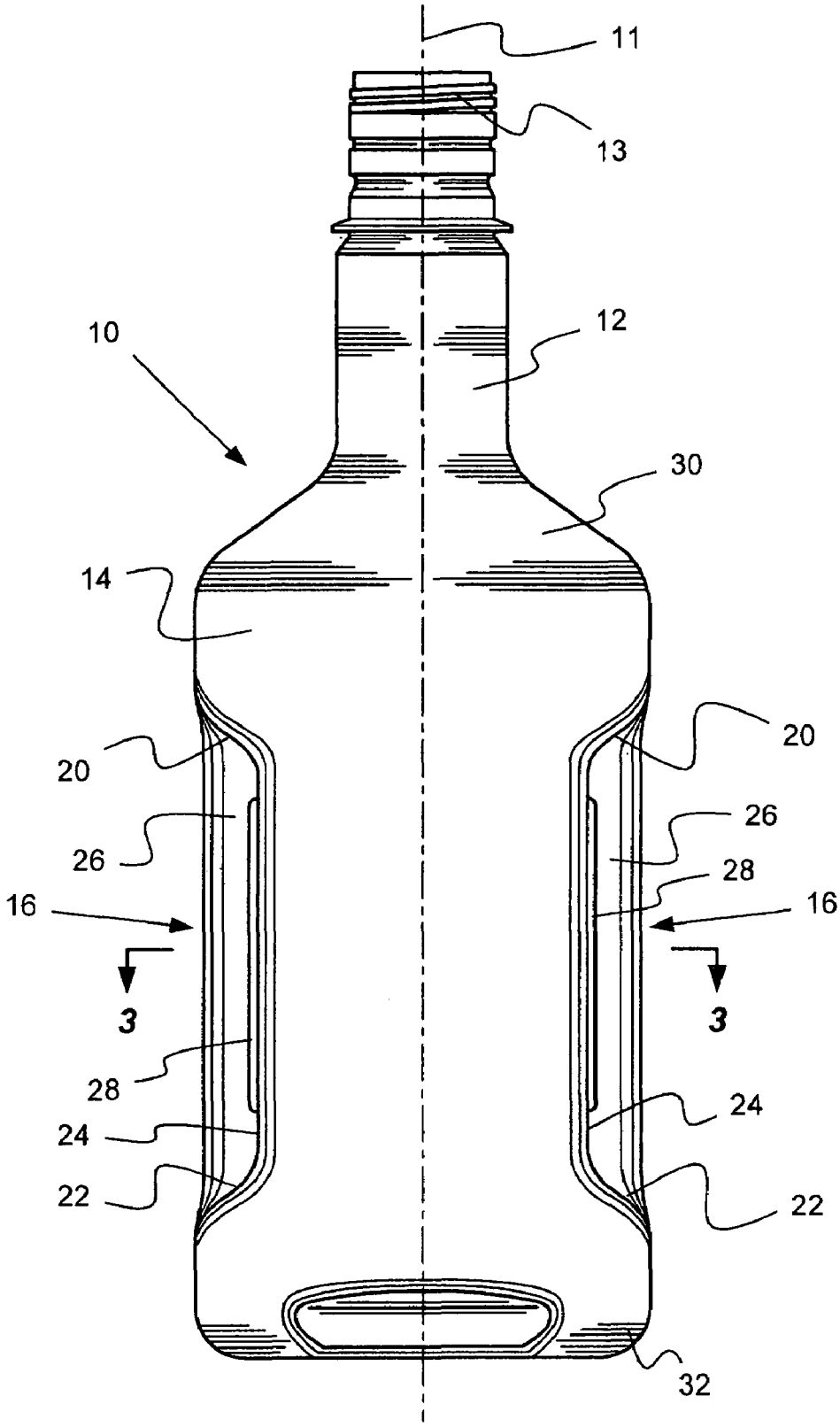
FIG. 2 is a rear elevational view of the container of FIG. 1.
Figure 3:
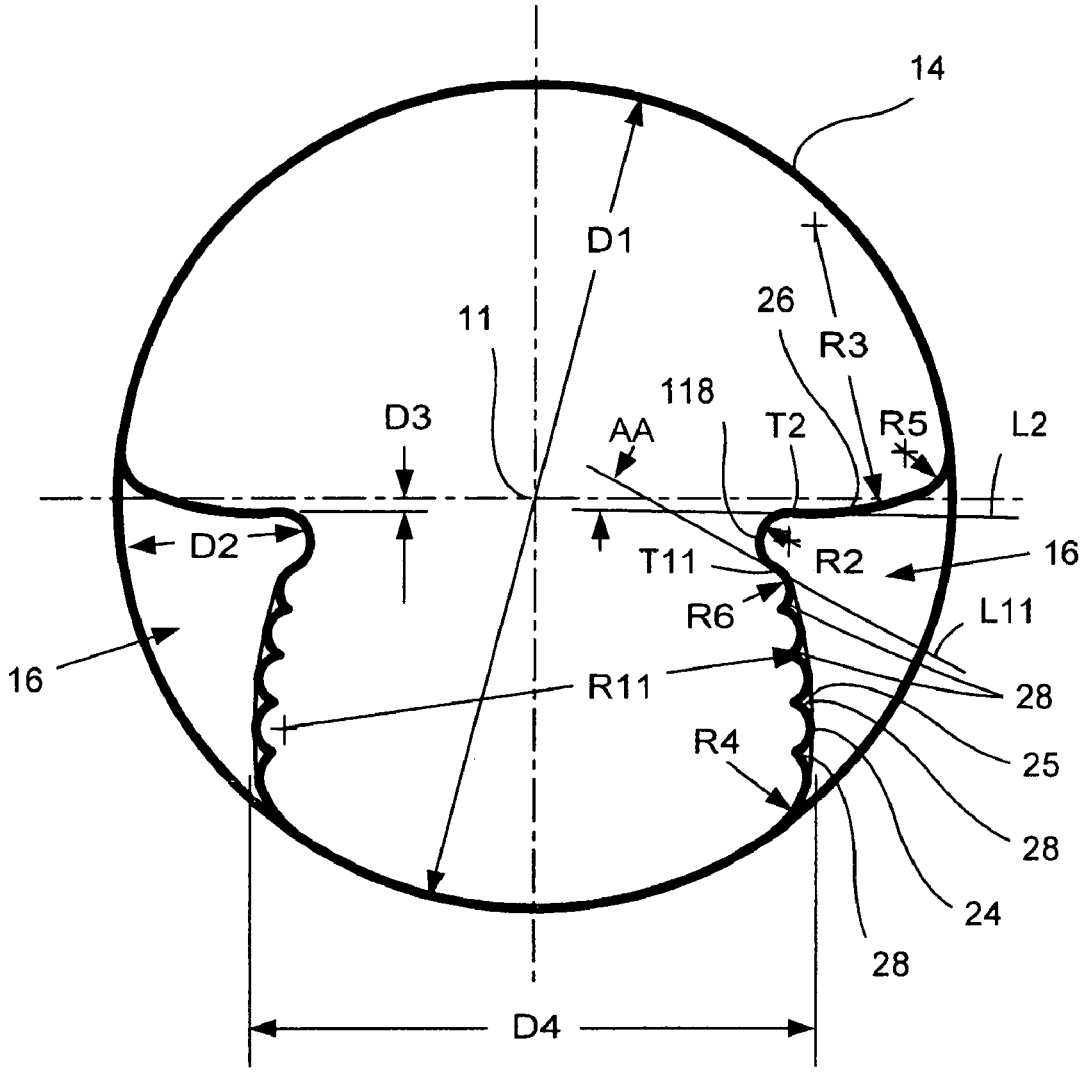
FIG. 3 is an enlarged cross-section view taken on line 3—3 of FIG. 2.
Figure 4:
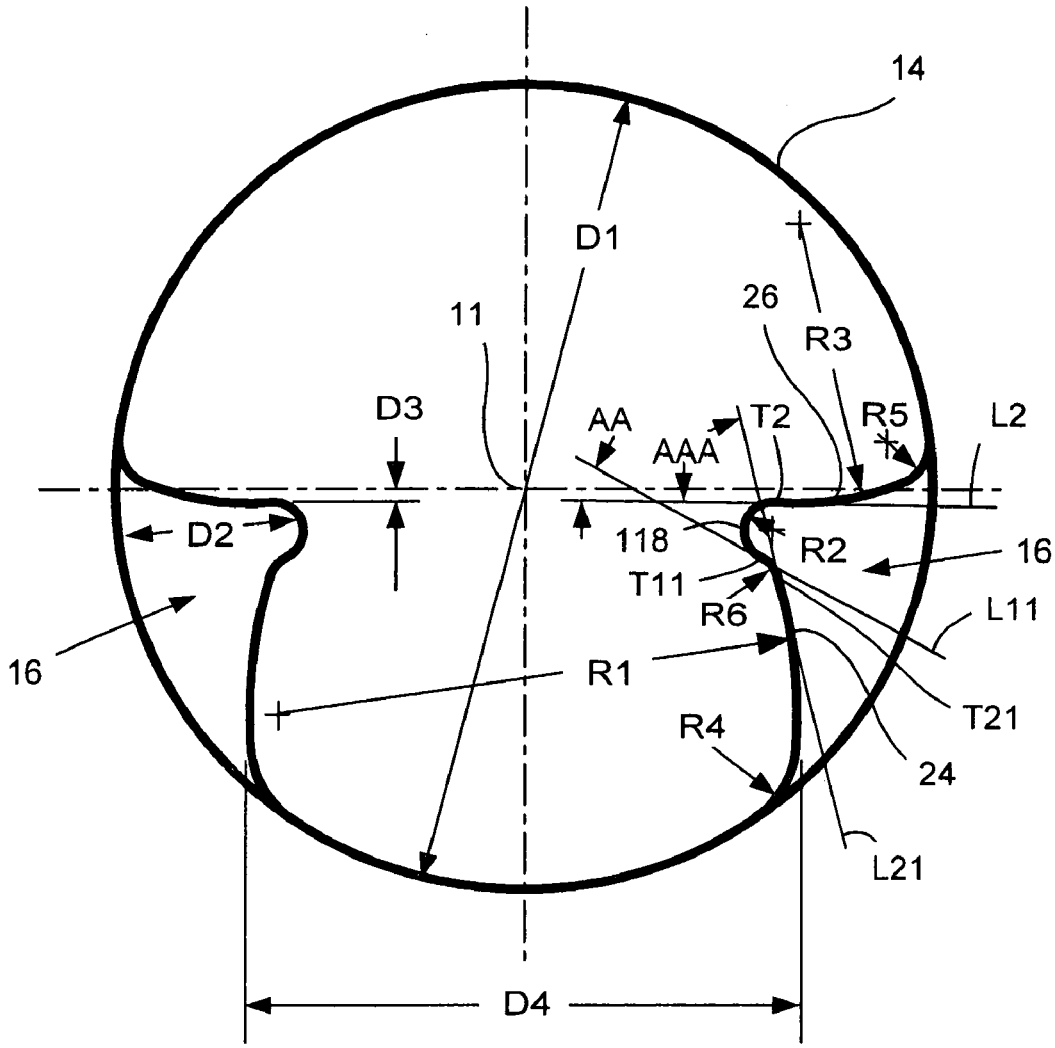
FIG. 4 is an enlarged cross-section view similar to FIG. 3 showing an alternative configuration.

FIGS. 1 and 2 respectively show a side and rear elevational view of a blow-molded plastic container according to the present invention. Container 10 preferably is made substantially of biaxially oriented polyethylene terephthalate polymer material and having a central axis 11. Bottle-shaped container 10 has an injection-molded finish 13 with an integral biaxial-oriented blow-molded neck 12, generally cylindrical container body 14, and bottom 32. Cylindrical container body 14 has two mirror image recesses 16 or handgrips 16 of trough shape depressed radially inward at opposite sides thereof between the vicinity of the bottom 32 and the vicinity of a shoulder 30 of container body 14. The finish 13 provides an opening (not illustrated) to the container 10 and neck 12 can be short or long in size in a direction parallel to axis 11. Recesses 16 have tapered sidewalls comprising top walls 20, bottom walls 22, first sidewalls 24, and second sidewalls 26. The first sidewall 24 and second sidewall 26 converge at inward ridge 18 or pronounced inward ridge 118 to form angle A or angle AA as shown in FIG. 3, 4, & 5. Further, first sidewall 24 in FIG. 3 has a plurality of longitudinal grooves 28 aligned axially with axis 11 at predetermined intervals preferably in parallel on opposite recesses 16. Grooves 28 help facilitate holding the container 10 by a user pouring from container 10 and may alternatively be aligned perpendicular to axis 11 or at some angle to axis 11. Accordingly, those skilled in the art will recognize that grooves 28 establish a grip-pattern that is one alternative. The grip pattern can assume any number of alternative patterns, including, a plurality of latitudinal grooves, diagonal grooves, chevron grooves, cobblestone shaped pattern projections, and others. In fact, the inventors recognize that the grip does not necessarily require any specific pattern on first sidewalls 24 as shown in FIG. 4.

FIGS. 1 and 2 also show further improvement offered in that grip recesses 16 can be axially longer than recesses of prior art containers having otherwise generally similar proportions, capacity, and weight. Recesses 16 can extend to points adjacent shoulder 30 and bottom 32 of the container body 14. The longer length of recesses 16 offer greater aesthetics and function. In prior art containers, such as that shown in the '941 patent, such an increase in the length would weaken the structure and make it more likely to evert. As will be shown in the following discussion referring to the figures, the structural rigidity geometry of this invention overcomes this weakness.

FIG. 3 is an enlarged cross-section view taken on line 3—3 of FIG. 2. FIG. 3 shows detail of angle AA relationship between first sidewall 24 and second sidewall 26 separated by pronounced inward ridge 118. Angle AA is an acute angle less than 90° and preferably 80° or less, and in the preferred embodiment shown in FIG. 3, angle AA is generally less than 40°. Sidewalls 24 and 26 are generally convex surfaces when one views from the outside of the container 10.

Figure 5:
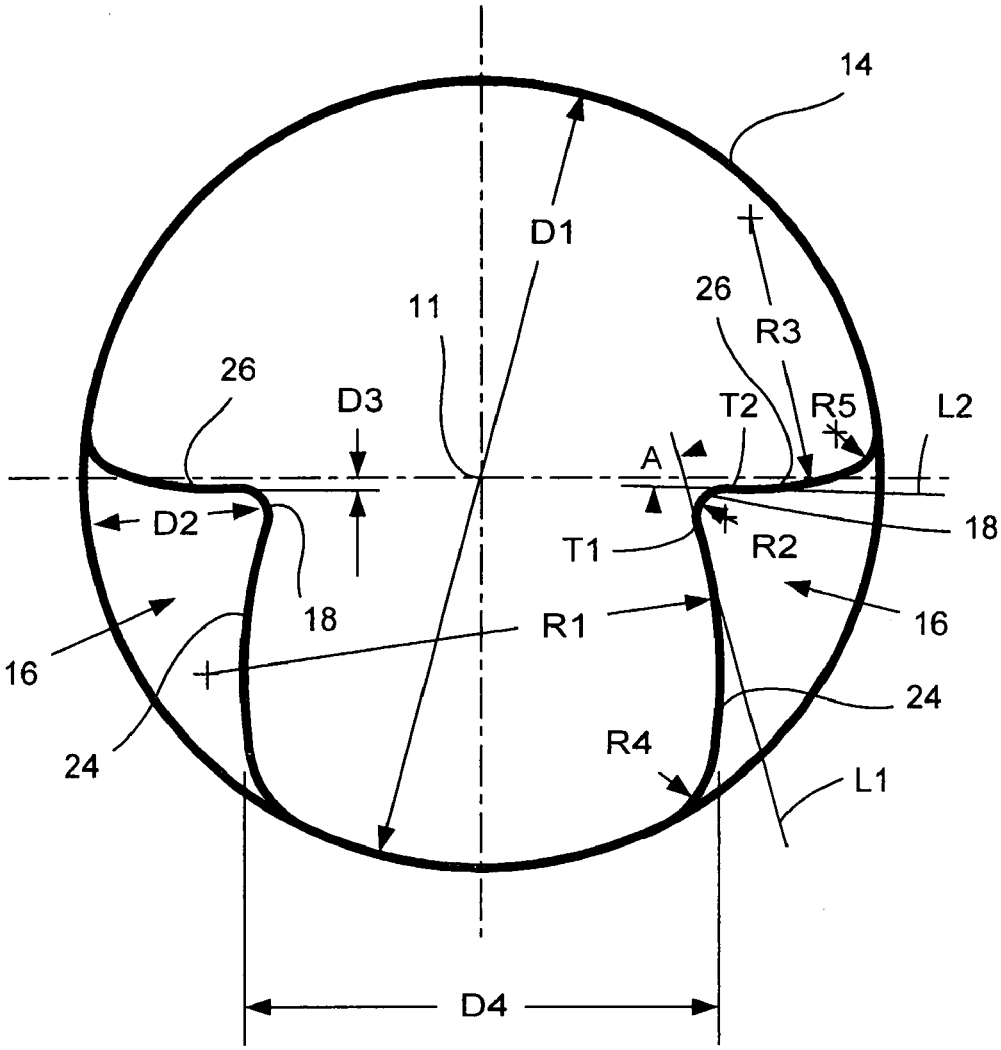
FIG. 5 is another enlarged cross-section view similar to FIG. 3 showing an earlier alternative configuration.

FIG. 5 is another enlarged cross-section view similar to FIG. 3 showing an earlier alternative configuration. Container body 14 has a size with a dimension D1. Dimension D1 for typical container is about 4.0 inches to about 5.0 inches. While container body 14 can be generally cylindrical with an overall generally circular cross-sectional configuration as in FIG. 5, the overall cross-sectional configuration of container body 14 can be a number of other configurations, including generally oval, generally rectangular, and generally square. Furthermore, while FIG. 1 clearly shows container body 14 having a body sidewall 15 that is substantially parallel to centerline 11, those skilled in the art will realize that handgrips 16 are equally applicable to a container having body sidewalls that are not substantially parallel, that is, body sidewalls tapered relative to the centerline.

As seen in the cross-section shown in FIG. 5, first sidewall 24 and second sidewall 26 are curved with first sidewall 24 having a curvature or general radius R1 and second sidewall 26 having a curvature or general radius R3. Generally, radius R1 will be measurably longer than radius R3 with radius R3 being greater than 1.0 inch. In the embodiment shown in FIG. 5, first sidewall 24, with radius R1, blends into container body 14 through radius R4. Likewise, second sidewall 26, with radius R3 blends into container body 14 through radius R5. The dimension of radius R4 and R5 can be any suitable radius providing a smooth transition between handgrip 16 and container body 14. Those skilled in the art will realize that first sidewall 24 and second sidewall 26 can each have a configuration comprising a number of similar but slightly different radii to create a complex generally convex curvature with a desired smooth transitions and effects. Furthermore, top wall 20 and bottom wall 22 are of any convenient configuration to smoothly blend with first sidewall 24, second sidewall 26, inward ridge 18 or pronounced inward ridge 118, including configurations having a generally flat character, a generally concave curvature, or a generally convex curvature.

Between radius R1 and R3 is inward ridge 18 having radius R2 of about 0.05 to about 0.18 inch. Radii R1 and R2 smoothly blend and transition to each other at a tangent point T1 in the cross-sectional configuration of FIG. 5. Through tangent point T1 is an imaginary line L1 that is simultaneously tangent to both radii RI and R2. In other words, imaginary line L1 is perpendicular to both radii R1 and R2. Radii R2 and R3 smoothly blend and transition to each other at a tangent point T2. Through tangent point T2 is an imaginary line L2 that is simultaneously tangent to both radii R2 and R3. In other words, imaginary line L2 is perpendicular to both radii R2 and R3. Imaginary line L1 and imaginary line L2 intersect forming angle A. Angle A is an acute angle less than 90° and preferably 80° or less.

Each handgrip 16 has a dimension D2 indicating distance of inward depression. Dimension D2 for typical container is about 0.50 inch to about 1.25 inches and preferably about 0.75 inch to about 1.0 inch. Controlled by the physics of the container blow-mold manufacturing process and to assure adequate material thickness within the second sidewall 26, second sidewall 26 has an offset from centerline 11 by dimension D3. Generally, dimension D3 is greater than 0.06 inch.

To permit a thumb and fingers of a typical hand to easily grip container 10, container 10 has two handgrips 16, each the mirror image of the other and separated by dimension D4. For a typical container, dimension D4 is about 2.5 inches to about 3.75 inches.

FIG. 4 and FIG. 5 have substantially similar cross-sectional configurations except that in FIG. 4 a radius R6 establishes a smooth transition between general radius R1 and radius R2. Radius R6 can be of any convenient size; however, R6 typically will be close in size to radius R2. Radii R2 and R6 smoothly blend and transition to each other at tangent point T11. Through tangent point T11 is an imaginary line L11 that is simultaneously tangent to both radii R2 and R6. In other words, imaginary line L11 is perpendicular to both radii R2 and R6. Imaginary line L11 and L2 intersect forming angle AA more acute than angle A. In addition, general radius R1 and Radius R6 smoothly blend and transition to each other at tangent point T21. Through tangent point T21 is an imaginary line L21 that is simultaneously tangent to both radii R1 and R6. In other words, imaginary line L21 is perpendicular to both R1 and R6. Imaginary line L21 and L2 intersect forming angle AAA with an angle generally less than 90°.

First sidewall 24 in part with general radius R1 and radius R6 cooperate with second sidewall 26 with radius R3 to establish a pronounced inward ridge 118 with radius R2 similar to that of inward ridge 18. Pronounced inward ridge 118 has superior structure enabling ridge 118 to adequately resist eversion thus allowing recesses 16 to have a longer length than in the prior art.

FIG. 3 and FIG. 4 have substantially similar cross-sectional configurations except that first sidewall 24 further consists of a plurality of curves establishing longitudinal grooves 28 that as a unit generally conform to an imaginary foundation curve 25 with radius R11 that is similar to radius R1 in overall character. Grooves 28 help facilitate holding the container 10 by the user. First sidewall 24 with imaginary foundation curve 25 have an overall convex curvature appearance when one views the container from the outside.

The inventors believe that the angular relationship of first sidewall 24 with second sidewall 26, particularly in regions adjacent to inward ridge 18 or pronounced inward ridge 118, coupled with its inherently larger surface areas, allow forces generated in a liquid contained in container 10 during impact from a drop of container 10 to momentarily act on and slightly flex sidewalls 24 and 26 causing inward ridge 18 or pronounced inward ridge 118 to move and become slightly more explicit thereby further resisting handgrip 16 eversion. In effect, forces generated in the contained liquid at drop impact help hold inward ridge 18 or pronounced inward ridge 118, having generally less surface area than sidewalls 24 and 26, substantially in position allowing inherent structure of ridge 18 or 118 to better resist similar impact generated forces acting directly on ridge 18 or 118 at the same time.

Figure 6:
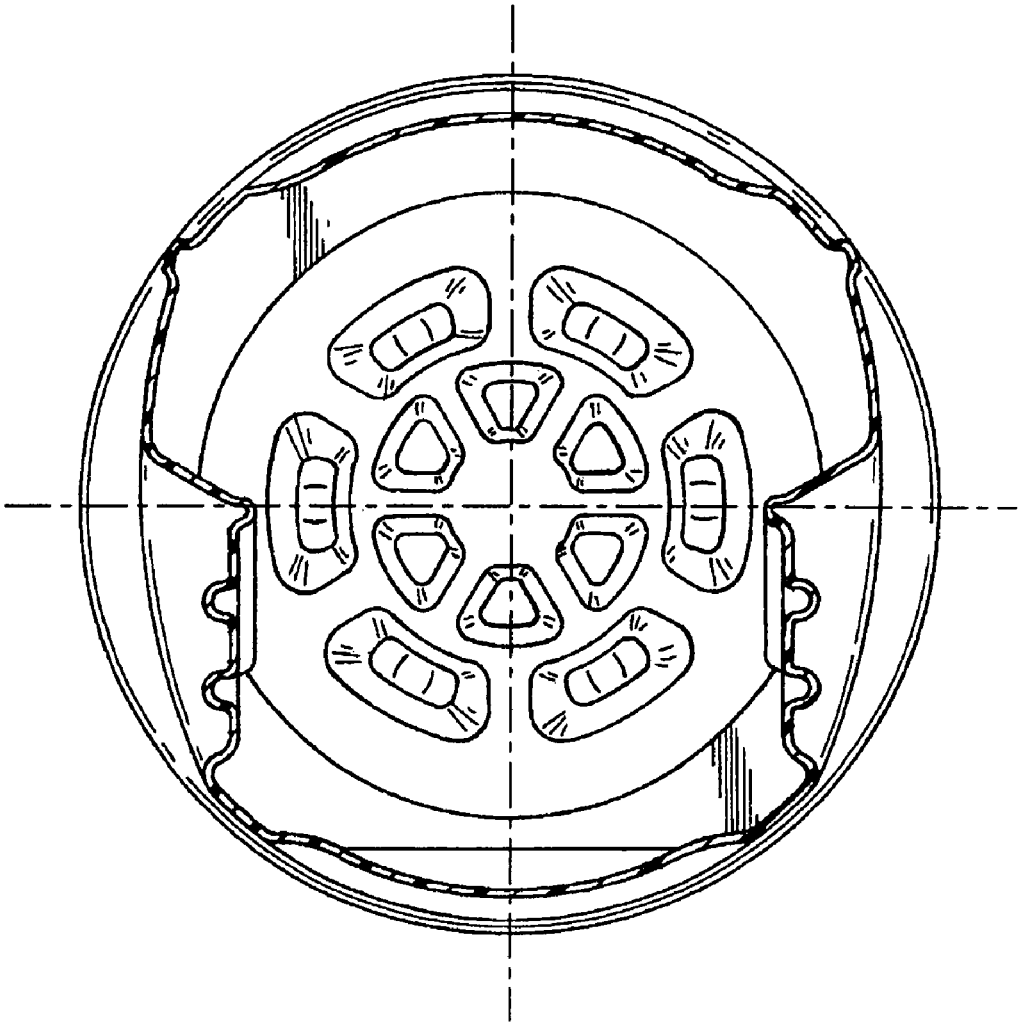
Fig. 6 Prior Art
FIG. 6 is a cross-sectional view of the prior art handgrip of U.S. Pat. No. 5,598,941.

FIG. 6 shows a cross-sectional view of the container and its handgrip of U.S. Pat. No. 5,598,941. The handgrip indentations comprise first and second vertical surfaces unitarily joined together at a common edge, the two surfaces being inclined with respect to each other at an obtuse angle. Note, the two surfaces are generally flat and have no underlying convex contour. The flat sidewalls converge at an inward rib. Because of the obtuse angle between the first and second vertical surfaces, forces generated within the contained liquid upon drop impact of the container act on the rib and vertical surfaces to actually promote handgrip eversion. In other words, handgrip geometry does not help focus these forces to briefly assist in holding inward rib position. Instead, only the inherent strength of the vertical sidewalls and inward rib resist the eversion.

The uniqueness of the opposing radii grip of this invention allows the resulting containers to pass the following cold-fill, two-foot drop test. The new grip addresses the grip eversion problem and improves feel without sacrificing appearance. Using geometry that consists of two sidewalls having radii wherein the sidewalls come together at an offset, inward ridge eliminated the everting grip problem. The combination of this edge and sidewalls each having a curved radius eliminates the need for lateral reinforcing ribs in both cold-fill and hot-fill containers.

Example of Invention in a Two-Foot Drop Test

Container manufacturers use the two-foot drop test for many larger plastic containers with built in handles or grips. During the filling, warehousing, and stocking of containers, handlers routinely drop containers up to two feet. This drop can occur during case packing, palletizing, shipping, storing, and shelving. When dropped the handgrips absorb much of the impact force. The definition of failure is when a container's handle pops outward and remains in the everted position. The handles must remain structurally intact in the inward position to pass the test.

Procedure:

ASTM Method 0-2463

Procedure (A)—Static Drop Method—this test method consists of dropping a sample lot of containers from a fixed height and reporting percent failures.

Procedure (B)—Bruceton Staircase Drop—this method consists of dropping all test specimens from various heights. The testing technician raises or lowers the drop height depending on the result of the preceding test sample. If the previous sample fails, the drop height is lowered by an increment, x; if the previous sample passes, the drop height is raised by x.

The following Examples demonstrate how this invention grip passes Procedure (A) and Procedure (B) for cold-filled containers. Grip A is a standard prior art grip. In Grip B, the walls are convex and converge along an axial line to form a pronounced inwardly directed ridge at the depth of the recess that is similar to that shown in FIG. 4. In Grip C, the convex first and second sidewalls meet at the depth of the recess without creating a pronounced inwardly directed ridge that is similar to that shown in FIG. 5. Except as noted, all containers were the same size, that is, 1.75 liters in capacity and the same weight.

EXAMPLE I

The result obtained from Procedure (A) is the percent failures of each test specimen dropped from a fixed height of 2 feet. Sample size was 50 containers.

TABLE 1

% Failures of 1.75 L Containers Using Various Grips

| Grip Type | % Failure |
|---|---|
| Grip A (Standard)(Prior Art) | 20 |
| Grip B | 0 |
| Grip C | 0 |

EXAMPLE II

The result obtained from Procedure (B) is the Estimated Mean Failure Height (EMFH), simply meaning the average failure height of any single group of test specimens.

TABLE 2

EMFH of 1.75 L Containers Using Various Grips

| Grip Type | EMFH (in.) |
|---|---|
| Grip A (Standard)(Prior Art) | 15 |
| Grip B | 44 |
| Grip C | 31 |

EXAMPLE III

The grip design may allow for light-weighting possibilities in containers with handles. The following shows excellent results with a lighter weight container.

TABLE 3

Performance of Radii Grip (B) at Different Weights

| Weight (g.) | % Failure (2 ft.) | EMFH (in.) |
|---|---|---|
| 104 | 0 | 44 |
| 100 | 0 | 32 |

The uniqueness of the opposing radii grip comes from its ability to address grip eversion and improve feel without sacrificing appearance. Using geometry that generally consists of two radii that come together at an inward ridge this geometry eliminates the everting grip problem. One hundred percent of the containers utilizing the proposed grip design passed the 24 inch drop test where only 80% of the containers with a prior art design grip passed. Furthermore, while some of the prior art containers survived a 24-inch drop under Procedure B, the average result was significantly below 24 inches.

The inventors provide the above detailed description of the present invention for explanatory purposes only. It will be apparent to those skilled in the art that numerous changes and modifications are possible without departing from the scope of the invention. Accordingly, one must construe the whole of the foregoing description in an illustrative and not a limitative sense; the appended claims solely define the scope of the invention.

We claim:

1. A blow-molded container having a central axis and made of a polymer comprising:

a body having a sidewall, adjacent the sidewall a shoulder and a bottom, adjacent the shoulder a neck, adjacent the neck a finish providing an opening to the container;

wherein, said sidewall has a pair of inwardly facing grip recesses spaced about its periphery;

each of said grip recesses being defined by a top wall and a bottom wall and a first sidewall and a second sidewall extending between the top wall and the bottom wall;

wherein said first sidewall and said second sidewall converge to form an inward ridge having a cross-sectional radius that smoothly blends with said curvature of said first sidewall and said curvature of said second sidewall; and wherein said first sidewall has a surface with a generally convex appearance having a cross-sectional curvature and said second sidewall has a surface with a generally convex appearance having a cross-sectional curvature different from said first sidewall.

2. A blow-molded container according to claim 1, wherein said first sidewall of each said grip recess has a grip pattern.

3. A blow-molded container according to claim 2, wherein said grip pattern is a plurality of longitudinal grooves.

4. A blow-molded container according to claim 2, wherein said grip pattern generally provides an overall convex curvature appearance.

5. A blow-molded container according to claim 1, wherein said radius of said inward ridge and said curvature of said first sidewall have a first common tangent and said radius of said inward ridge and said curvature of said second sidewall have a second common tangent and a first imaginary line through said first common tangent and a second imaginary line through said second common tangent converge with an acute angle less than 90°.

6. A blow-molded container according to claim 5, wherein said acute angle is at most 80°.

7. A blow-molded container according to claim 5, wherein said acute angle is at most 40°.

8. A blow-molded container according to claim 1, wherein said cross-sectional radius is about 0.05 inch to about 0.18 inch.

9. A blow-molded container according to claim 1, wherein said second sidewall of each grip recess of said pair of inwardly facing grip recesses have an offset from said central axis.

10. A blow-molded container according to claim 9, wherein said offset is more than 0.06 inch.

11. A blow-molded container according to claim 1, wherein each grip recess of said pair of inwardly facing grip recesses has an inward depression of about 0.50 inch to about 1.25 inches.

12. A blow-molded container according to claim 11, wherein said inward depression is about 0.75 inch to about 1 .0 inch.

13. A blow-molded container according to claim 1, wherein said curvature of said first sidewall has a general radius greater than a general radius of said curvature of said second sidewall.

14. A blow-molded container having a central axis and made of a polymer comprising:

a body having a sidewall, adjacent the sidewall a shoulder and a bottom, adjacent the shoulder a neck, adjacent the neck a finish providing an opening to the container;

wherein, said sidewall has a pair of inwardly facing grip recesses spaced about its periphery;

each of said grip recesses being defined by a top wall and a bottom wall and a first sidewall and a second sidewall extending between the top wall and the bottom wall;

wherein said first sidewall and said second sidewall converge to form an inward ridge and the inward ridge has a cross-sectional radius that smoothly blends with the first sidewall and with the second sidewall;

wherein said first sidewall has a surface with a generally convex appearance having a cross-sectional curvature and said second sidewall has a surface with a generally convex appearance having a cross-sectional curvature different from said first sidewall; and wherein said radius of said inward ridge and said curvature of said first sidewall have a first common tangent and said radius and said curvature of said second sidewall have a second common tangent and a first imaginary line through said first common tangent and a second imaginary line through said second common tangent converge with an acute angle.

15. A blow-molded container according to claim 14, wherein said inward ridge is pronounced having an acute angle at most 40°.

16. A blow-molded container according to claim 14, wherein said second sidewall of each grip recess of said pair of inwardly facing grip recesses have an offset from the central axis of more than 0.06 inch.

17. A blow-molded container according to claim 14, wherein said top wall of each of said grip recesses is adjacent to the container shoulder and said first sidewall and said second side wall extend from the top wall to said bottom wall, and said bottom wall is adjacent to said container bottom.

18. A blow-molded container having a central axis and made of a polymer comprising:

a body having a sidewall, adjacent the sidewall a shoulder and a bottom, adjacent the shoulder a neck, adjacent the neck a finish providing an opening to the container;

wherein, said sidewall has a pair of inwardly facing grip recesses spaced about its periphery;

each of said grip recesses being defined by a top wall and a bottom wall and a first sidewall and a second sidewall extending between the top wall and the bottom wall;

wherein said first sidewall and said second sidewall converge to form an inward ridge and the inward ridge has a cross-sectional radius that smoothly blends with the first sidewall and with the second sidewall;

wherein said first sidewall has a surface with a generally convex appearance having a cross-sectional curvature and said second sidewall has a surface with a generally convex appearance having a cross-sectional curvature different from said first sidewall;

wherein said radius of said inward ridge and said curvature of said first sidewall have a first common tangent and said radius and said curvature of said second sidewall have a second common tangent and a first imaginary line through said first common tangent and a second imaginary line through said second common tangent converge with an acute angle; and wherein said second sidewall of each of the grip recesses has an offset from the central axis.

* * * * *